US009308979B2

(12) United States Patent
Mostoviy

(10) Patent No.: US 9,308,979 B2
(45) Date of Patent: Apr. 12, 2016

(54) REVERSIBLE CAMBER SOFT WING SAIL

(71) Applicant: Stanislav Mostoviy, Long Island City, NY (US)

(72) Inventor: Stanislav Mostoviy, Long Island City, NY (US)

( * ) Notice: Subject to any disclaimer, the term of this patent is extended or adjusted under 35 U.S.C. 154(b) by 331 days.

(21) Appl. No.: 13/785,376

(22) Filed: Mar. 5, 2013

(65) Prior Publication Data

US 2013/0233229 A1 Sep. 12, 2013

Related U.S. Application Data

(60) Provisional application No. 61/607,118, filed on Mar. 6, 2012, provisional application No. 61/730,927, filed on Nov. 28, 2012.

(51) Int. Cl.
*B63B 9/06* (2006.01)
*B63H 9/06* (2006.01)

(52) U.S. Cl.
CPC ..... *B63H 9/0607* (2013.01); *B63H 9/0614* (2013.01)

(58) Field of Classification Search
CPC ..... B63H 9/06; B63H 9/0607; B63H 9/0614; B63H 9/0621
USPC ..... 114/102.1, 102.22–102.28
See application file for complete search history.

(56) References Cited

U.S. PATENT DOCUMENTS 1,755,886 A * 4/1930 McKenzie ..... 244/219
2,969,207 A * 1/1961 Fain et al. ..... 244/219
3,332,383 A * 7/1967 Wright ..... B63H 9/0607 114/102.16
4,064,821 A 12/1977 Roberts et al.
4,074,646 A * 2/1978 Dorfman et al. ..... 114/140
4,186,680 A 2/1980 Harpole
4,341,176 A 7/1982 Orrison
4,369,724 A 1/1983 Weiss
4,386,574 A 6/1983 Riolland
4,388,888 A 6/1983 Gushurst et al.
4,402,277 A 9/1983 Wainwright
4,437,426 A 3/1984 Latham
4,530,301 A 7/1985 Latham
4,537,146 A 8/1985 Wainwright
4,624,203 A 11/1986 Ferguson
4,625,671 A 12/1986 Nishimura
4,637,331 A 1/1987 Jackson
4,646,671 A 3/1987 Innes et al.
4,649,848 A 3/1987 Belvedere (Continued)

OTHER PUBLICATIONS

International Search Report—PCT/US13/29236—International Searching Authority, USPTO (May 13, 2013).

(Continued)

*Primary Examiner* — Ajay Vasudeva
(74) *Attorney, Agent, or Firm* — Muncy, Geissler, Olds & Lowe, P.C.

(57) ABSTRACT

A reversible wing sail for use with a wind-powered vehicle is provided herein that comprises a rotatable mast, a multi-surface sail cover, and a spring-assisted camber inducer. The rotatable mast generally has a longitudinally extending mast axis and the multi-surface sail cover runs along at least a portion of the mast, extending transversely in relation to the mast from a leading edge to a trailing edge. The sail cover has a first surface and a second surface that form a cavity therebetween. The spring-assisted camber inducer is arranged in the cavity between the first and second surfaces of the sail cover and configured to induce an asymmetric camber profile between the first and second surfaces to form the wing sail into an airfoil shape.

18 Claims, 8 Drawing Sheets

(56) References Cited

U.S. PATENT DOCUMENTS

| | | | | |
|---|---|---|---|---|
| 4,685,410 | A | 8/1987 | Fuller | |
| 4,699,073 | A | 10/1987 | Farneti | |
| 4,702,191 | A | 10/1987 | Minami et al. | |
| 4,703,707 | A | 11/1987 | Anderson | |
| 4,704,979 | A | 11/1987 | Ammen et al. | |
| 4,708,078 | A | 11/1987 | Legaignoux et al. | |
| 4,708,079 | A | 11/1987 | Magnan | |
| 4,733,624 | A | 3/1988 | Belvedere | |
| 4,741,282 | A | 5/1988 | Duke | |
| 4,753,186 | A | 6/1988 | Paras | |
| 4,757,779 | A | 7/1988 | Graveline | |
| 4,770,113 | A | 9/1988 | Walker | |
| 4,848,258 | A | 7/1989 | Priebe | |
| 4,852,507 | A | 8/1989 | Ryon et al. | |
| 4,864,949 | A | 9/1989 | Olsen | |
| 4,879,961 | A | 11/1989 | Aguilera | |
| 5,035,194 | A * | 7/1991 | Dougherty | 114/102.25 |
| 5,119,748 | A | 6/1992 | Nishimura | |
| 5,263,429 | A | 11/1993 | Brinkmann | |
| 5,271,349 | A | 12/1993 | Magrini | |
| 5,279,241 | A | 1/1994 | Aguilera | |
| 5,423,276 | A | 6/1995 | Nishimura | |
| 5,775,249 | A | 7/1998 | Samuel | |
| 5,799,601 | A | 9/1998 | Peay | |
| 5,868,092 | A | 2/1999 | Milidragovic | |
| 6,170,421 | B1 | 1/2001 | Ross | |
| 6,199,796 | B1 | 3/2001 | Reinhard | |
| 6,347,769 | B1 | 2/2002 | To et al. | |
| 6,622,974 | B1 | 9/2003 | Dockter et al. | |
| 6,892,659 | B2 | 5/2005 | Petretto | |
| 7,114,456 | B2 | 10/2006 | Sohy | |
| 7,574,972 | B1 | 8/2009 | Fairchild | |

OTHER PUBLICATIONS

Written Opinion—PCT/US13/29236—International Searching Authority, USPTO (May 13, 2013).

D. Kasler, "Inflatable Wing Sail," http://www.olypen.com/dkaseler/inflatable.htm, accessed Mar. 23, 2013.

* cited by examiner

REVERSIBLE CAMBER SOFT WING SAIL

CLAIM OF PRIORITY UNDER 35 U.S.C. §119

The present application for patent claims priority to U.S. Provisional Application No. 61/730,927 entitled "Reversible Camber Soft Wing Sail" filed on Nov. 28, 2012, and to U.S. Provisional Application No. 61/607,118 entitled "Reversible Double Surface Airfoil Sail With Pneumatic Spring Loaded Camber" filed on Mar. 6, 2012, which are expressly incorporated by reference herein.

BACKGROUND

1. Field

The present disclosure relates generally to airfoils for use with wind-powered vehicles, and more particularly to a reversible camber soft wing sail.

2. Background

Conventional single surface sails made out of thin materials provide limited performance, especially in high wind conditions. Other more complex designs have therefore been proposed to form sails into an airfoil shape similar to the shape of an airplane wing. The same aerodynamic principles that apply to horizontal aircraft wings also apply when the wing is positioned vertically on end. When used by wind-powered vehicles such as sailboats, windsurfing boards, etc., these vertical airfoils are often referred to as wing sails.

Wing sails differ from conventional sails in that they have two surfaces of curvature rather than a single thin surface. The two surfaces create a pressure differential by forcing air to flow past them at different velocities, thereby creating lift. As a result, high lift airfoils are asymmetrical and only generate lift efficiently in one direction. This presents a challenge for various sailing applications, where the sail's airfoil camber is required to reverse in order to tack. Conventional sails are able to reverse due to the flexibility of their material. However, tacking in this manner is more difficult with a wing sail due to its thicker, three dimensional shape.

Numerous wing sail designs with unique configurations have been developed, but each has had its own drawbacks and shortcomings Examples include two ply sails wrapped around a spar or filled with foam padding, wings with asymmetrical but fixed chordal profiles, symmetrical sails with inflatable media between two plies, and others. Prior designs such as these are often too complicated for production and difficult to operate.

Accordingly, there remains a need in the art for improved wing sails capable of offering the advanced aerodynamic performance of an airfoil while being user-friendly and cost-effective to manufacture.

SUMMARY

Embodiments disclosed herein address the above stated needs by providing improved wing sails with asymmetric yet reversible camber profiles. For example, a reversible wing sail for use with a wind-powered vehicle is provided herein that comprises a rotatable mast, a multi-surface sail cover, and a spring-assisted camber inducer. The rotatable mast generally has a longitudinally extending mast axis and the multi-surface sail cover runs along at least a portion of the mast, extending transversely in relation to the mast from a leading edge to a trailing edge. The sail cover has a first surface and a second surface that form a cavity therebetween. The spring-assisted camber inducer is arranged in the cavity between the first and second surfaces of the sail cover and configured to induce an asymmetric camber profile between the first and second surfaces to form the wing sail into an airfoil shape.

The spring-assisted camber inducer may be further configured to reverse the orientation of the asymmetry in the camber profile between the first and second surfaces in response to wind pressure incident on the sail cover. The spring-assisted camber inducer may form an asymmetric camber leading surface region in the sail cover that extends from the leading edge to a mid-point short of the trailing edge and a symmetric camber trailing surface region in the sail cover that extends from the mid-point to the trailing edge. In some designs, the wing sail may further comprise an extension arm coupled to a base end of the mast and configured to extend the leading surface region of the sail cover relative to the trailing surface region.

In certain embodiments, the spring-assisted camber inducer may comprise a pneumatic spring mechanism formed from an array of air-filled cells. Each air-filled cell may extend in the longitudinal direction along the mast (e.g., halfway down or further). The array may comprise at least two air-filled cells connected in sequence to one another, for example, including a front cell disposed closest to the mast and a back cell disposed furthest away from the mast. The wing sail may further comprise one or more camber holders configured to rotatably couple the front cell to the mast.

In other embodiments, the spring-assisted camber inducer may comprise a mechanical spring mechanism formed from two or more rigid members rotatably coupled together by an elastic member. The rigid members may comprise, for example, a camber plate rotatably coupled to the mast, a trailing surface arm rotatably and slidably coupled to the camber plate, and an inner surface arm rotatably coupled to the mast and the trailing surface arm. The elastic member may be a spring configured to drive the camber plate and the trailing surface arm into an extended position relative to the inner surface arm. The mechanical spring mechanism may further comprise one or more stops configured to limit the induced camber to a predefined maximum amount.

In still other embodiments, the spring-assisted camber inducer may comprise both a pneumatic spring mechanism and a mechanical spring mechanism arranged in combination. The pneumatic spring mechanism may be formed from an array of air-filled cells and the mechanical spring mechanism may be formed from two or more rigid members rotatably coupled together by an elastic member. In still other embodiments, the spring-assisted camber inducer may comprise a mechanical spring mechanism formed from a lever, a guide arm, and a main plate rotatably and/or slidably coupled together by a tensioning member.

BRIEF DESCRIPTION OF THE DRAWINGS

The accompanying drawings are presented to aid in the description of embodiments of the invention and are provided solely for illustration of the embodiments and not limitation thereof.

DETAILED DESCRIPTION

Aspects of the present invention are disclosed in the following description and related drawings directed to specific embodiments of the invention. The term "embodiments of the invention" does not require that all embodiments of the invention include the discussed feature, advantage, process, or mode of operation, and alternate embodiments may be devised without departing from the scope of the invention. Additionally, well-known elements of the invention may not be described in detail or may be omitted so as not to obscure other, more relevant details.

As discussed in the background above, conventional wing sail designs have been heretofore inadequate. To varying degrees, they have been cumbersome, difficult for users to operate, and complicated to manufacture. Accordingly, improved wing sail structures, techniques, and related methods of manufacture are described herein that address the shortcomings of conventional designs by providing a new cambered airfoil design with an asymmetrical reversible aerodynamic profile. Improved sails of this type may be useful in various wind-powered applications, such as windsurfing, sailboats, or generally any vessel suitable for propulsion over ice, land, or water. Additional aspects and advantages will become apparent from a consideration of the drawings and description below.

Figure 1:
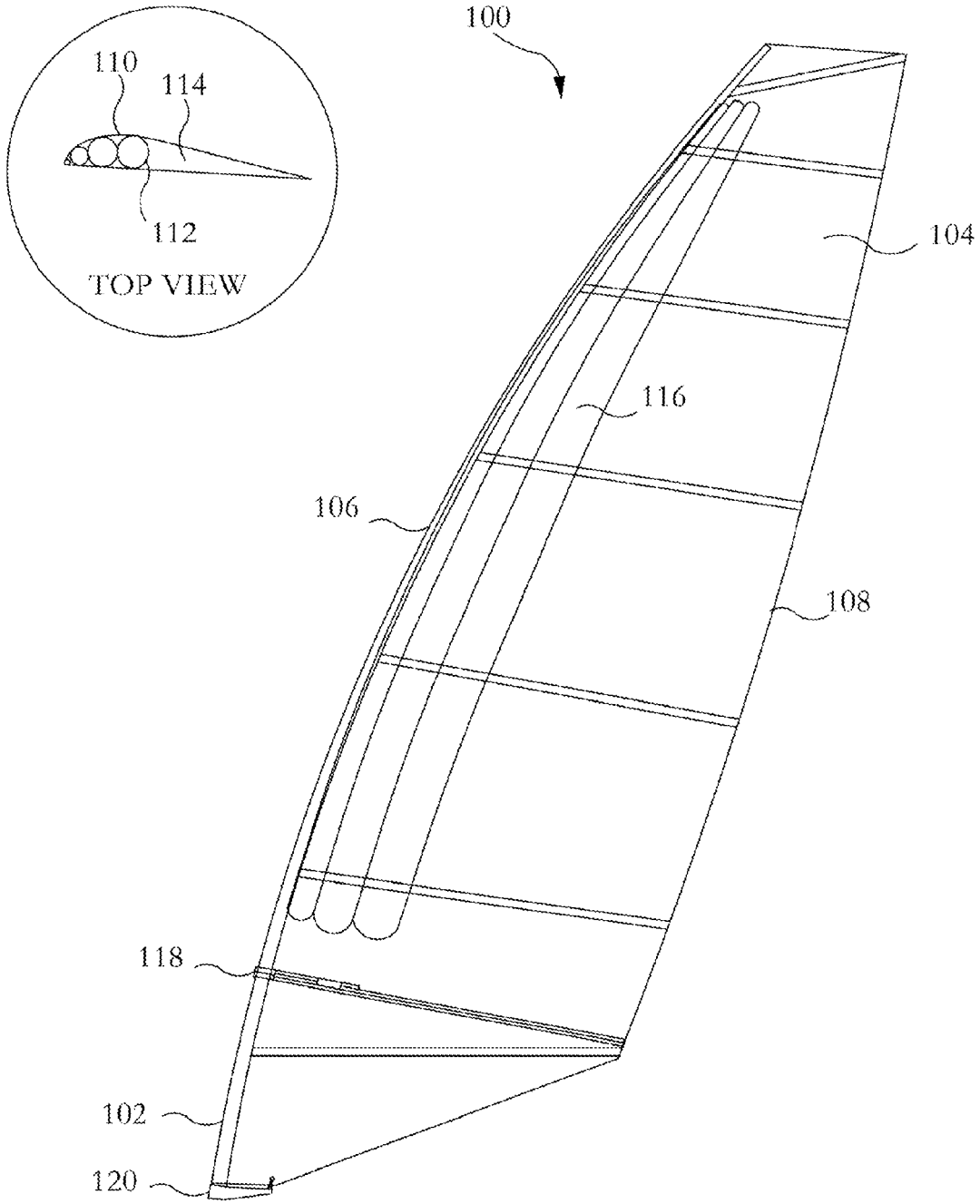
FIG. 1 illustrates an example reversible wing sail for use with a wind-powered vehicle according to various embodiments.

FIG. 1 illustrates an example reversible wing sail 100 for use with a wind-powered vehicle according to various embodiments. As shown, the wing sail 100 generally includes a rotatable mast 102 having a longitudinally extending mast axis. Coupled to the mast 102 is a multi-surface sail cover 104 running along at least a portion of the mast 102 and extending transversely in relation to the mast 102 from a leading edge 106 to a trailing edge 108. The sail cover 104 has a first surface 110 on one side and a second surface 112 on the other side, such that the two surfaces form a cavity 114 therebetween.

The mast 102 may be made of a light weight, rigid material such as aluminum, carbon fiber, wood, or other materials known in the art. The mast 102 is connectable to a base or some other coupling mechanism of the wind-powered vehicle with which it is employed, providing for its rotation about the mast axis. In this way, the angle of attack of the wing sail 100 may be adjusted during operation. The mechanism for securing and rotating the mast 102 is not shown as such mechanisms are well-known in the art. The sail cover 104 may similarly be made of any suitable material, such as monofilm or sailcloth, or any combination thereof, as is also known in the art.

According to various embodiments, the wing sail 100 is further outfitted with one or more spring-assisted camber inducers 116, 118 arranged in the cavity 114 between the first and second surfaces 110, 112 of the sail cover 104. The spring-assisted camber inducers 116, 118 are each configured to induce an asymmetric camber profile between the first and second surfaces 110, 112 to form the wing sail 100 into an airfoil shape. In this way, it will be appreciated that the spring-assisted camber inducer(s) 116, 118 may form an asymmetric camber leading surface region in the sail cover 104 that extends from the leading edge 106 to some mid-point short of the trailing edge 108 and a symmetric camber trailing surface region in the sail cover 104 that extends the rest of the way from the mid-point to the trailing edge 108.

Two example spring assisted camber inducers 116, 118 are shown in FIG. 1, including a pneumatic spring mechanism 116 and a mechanical spring mechanism 118.

Figure 2:
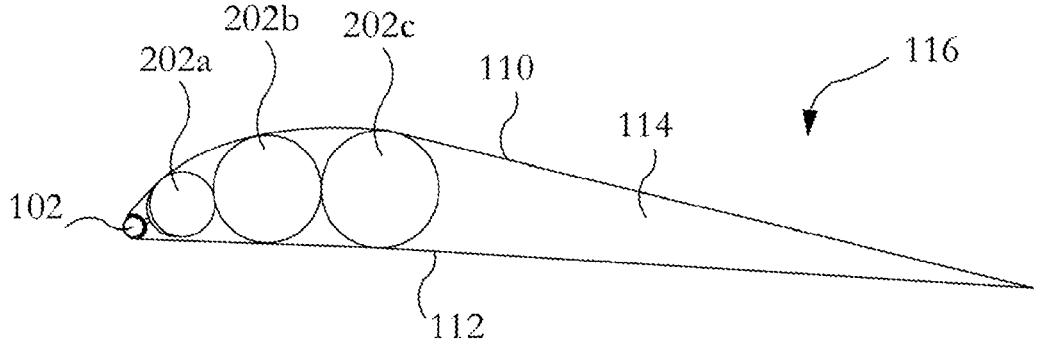
FIG. 2 is a cross-sectional view that illustrates an example pneumatic spring mechanism in more detail.

FIG. 2 is a cross-sectional view that illustrates the pneumatic spring mechanism 116 in more detail. As shown, the pneumatic spring mechanism 116 may be constructed, for example, from an array of air-filled cells 202*a-c* (collectively 202) arranged in the cavity 114 between the first and second surfaces 110, 112 of the sail cover 104. The cells 202 may be connected, for example, by forming them from a common piece of fabric stitched or otherwise sealed between individual cells. Alternatively, the cells 202 may be formed individually and stitched, fastened, or otherwise connected together. Suitable material from which the cells 202 may be formed includes nylon, polyester, thermoplastic polyurethane, or generally any other material that is sealable so as to retain air under pressure yet flexible so that the cells 202 may pivot around each other when the camber is adjusted. As used herein, it will be appreciated that the term "air" simply refers to any gas or other compressible medium, not to a particular mixture or concentration of elements. "Air-filled" does not require, for example, that atmospheric concentrations of air be used, as other media (e.g., helium, carbon dioxide, foam, etc.), or combinations thereof, may alternatively be employed in different applications.

Figure 3:
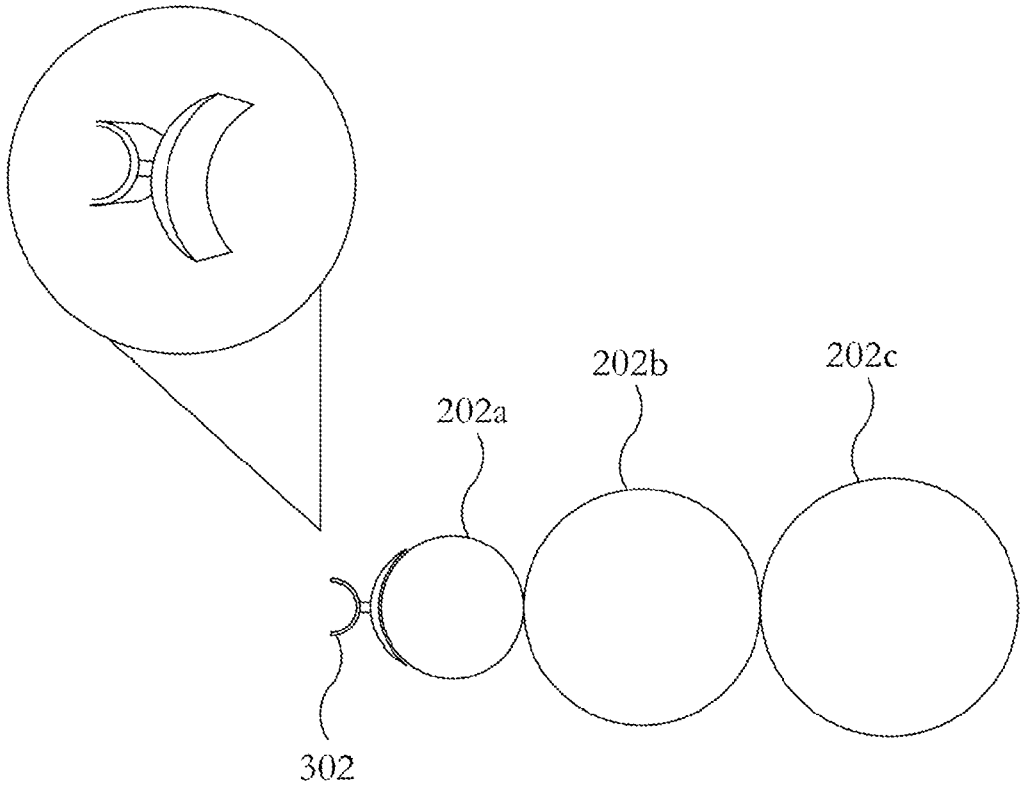
FIG. 3 illustrates an example camber holder.

Returning to FIG. 1, the pneumatic spring mechanism 116 and its air-filled cell 202 can be seen to extend in the longitudinal direction along the mast 102 (e.g., halfway down or further). A plurality of three air-filled cells 202*a*, 202*b*, and 202*c* is shown for illustration purposes, but other numbers of air-filled cells 202 (e.g., four or five) may also be used as desired. The air-filled cells 202 are accordingly arranged so as to include a front cell 202*a* disposed closest to the mast 102 and a back cell 202*c* disposed furthest away from the mast 102. The front cell 202*a* may be connected to the mast 102 and the back cell 202*c* may be connected to the sail cover 104. To this end, the wing sail 100 may further comprise one or more camber holders configured to rotatably couple the front cell 202*a* to the mast 102. An example camber holder 302 is illustrated in FIG. 3. The back cell 202*c* may be connected to the sail cover 104 by stitching, glue, zippers, or other fasteners. The particular sizes and relative sizes of the individual cells 202 in the array may be selected so as to define the desired camber and resultant airfoil shape.

Figure 4:
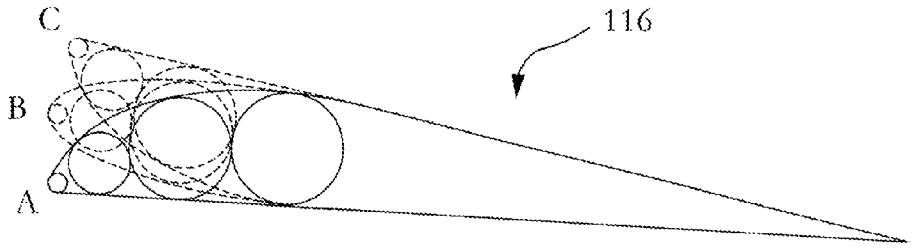
FIG. 4 illustrates an example camber profile formed by a pneumatic spring mechanism in three example positions of the wing sail.

FIG. 4 illustrates the asymmetric camber profile formed by the pneumatic spring mechanism 116 in three example positions of the wing sail 100, as it moves from a maximum camber position on one side of the mast 102 (position A) through a minimum or neutral camber position (position B) to a second maximum camber position on the other side of the mast 102 (position C). The ability to reverse the camber from one side of the mast 102 to the other allows the wing sail 100 to change the direction of the lift being generated, such as when tacking or otherwise changing directions.

The reversal may be achieved by applying a compressive force to the pneumatic spring mechanism 116 in the cambered region of the wing sail 100 (e.g., to the leading surface region of the sail cover 104 described above). As the pneumatic spring mechanism 116 is compressed while on a first side of the mast 102 (position A), the tension in the sail cover 104 is decreased, allowing it to move into the neutral position (position B). Upon reaching the neutral position, the pneumatic spring mechanism 116 may continue to be forced in the opposite direction, causing it to the push out to the other side of the mast 102 (position C) and form an asymmetric camber in the sail cover 104 of the opposite orientation.

The compressive force may be provided automatically by wind pressure incident on the sail cover 104, or by some other external force, such as manual force from a user. In this way, the pneumatic spring mechanism 116 may be configured to automatically reverse the asymmetric camber between the wing sail 100 surfaces in response to wind pressure, for example, making the wing sail 100 self-orienting with regard to the angle of attack and the apparent wind.

Figure 5:
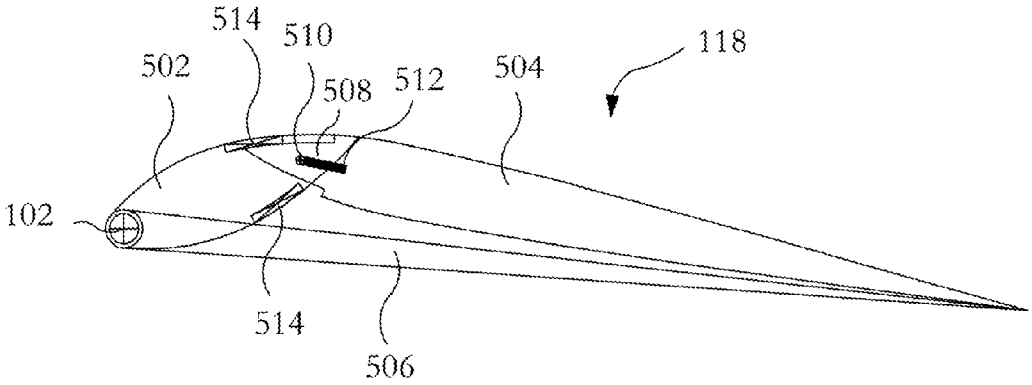
FIG. 5 is a cross-sectional view that illustrates an example mechanical spring mechanism in more detail.
Figure 6:
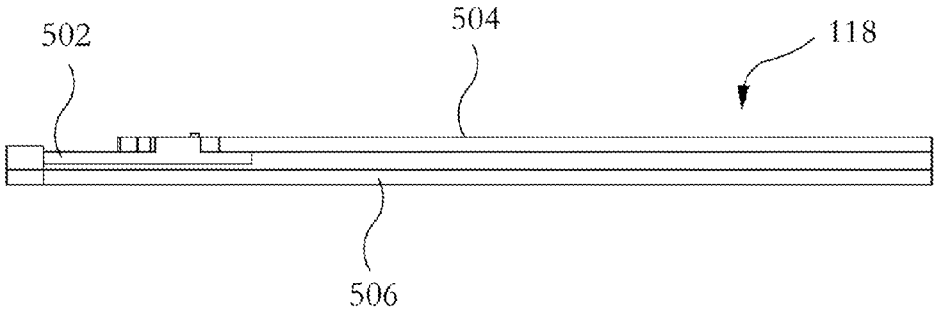
FIGS. 6-8 illustrate different views and provide varying perspectives of the components of the mechanical spring mechanism shown in FIG. 5.
Figure 7:
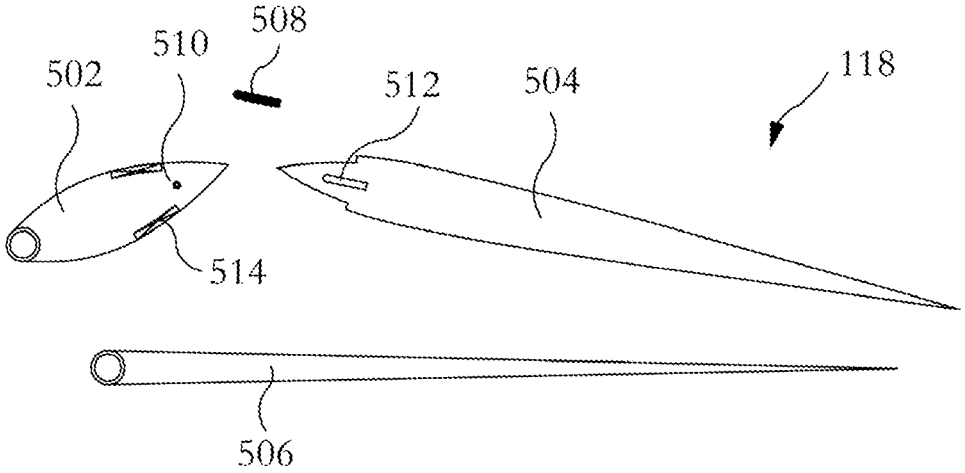
Figure 8:
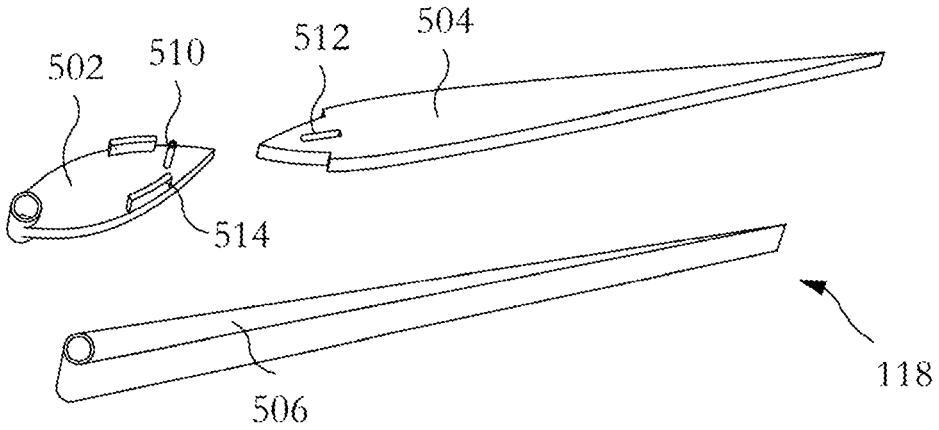

FIG. 5 is a cross-sectional view that illustrates the mechanical spring mechanism 118 in more detail. As shown, the mechanical spring mechanism 118 may be constructed, for example, from two or more rigid members 502, 504, 506 rotatably coupled together by an elastic member 508. FIGS. 6-8 illustrate different views and provide varying perspectives of the components of the mechanical spring mechanism 118 shown in FIG. 5.

In this example design, the rigid members 502, 504, 506 comprise a camber plate 502 configured to induce camber the leading surface of the sail cover 104, a trailing surface arm 504 configured to maintain the trailing surface of the sail cover 104, and an inner surface arm 506 configured to maintain the inner surface of the sail cover. The camber plate 502 may be rotatably coupled to the mast 102, such as via a pivoting joint. The trailing surface arm 504 may be rotatably and slidably coupled to the camber plate 502, such as by a pivot cylinder 510 and an associated channel 512 in which the pivot cylinder 510 is able to slide. The inner surface arm 506 may be rotatably coupled to the mast 102 and the trailing surface arm 504, such as via respective pivoting joints.

The elastic member 508 may be constructed from a spring configured to drive the camber plate 502 and the trailing surface arm 504 into an extended position relative to the inner surface arm 506. For example, the spring may be disposed in the channel 512 and push against the pivot cylinder 510. In other embodiments, the elastic member may be any other type of a resilient member (e.g., a bungee cord, a gas strut, etc.) able to provide a restoring force to drive the camber plate 502 and the trailing surface arm 504 into an extended position while being sufficiently compressive to allow for reversing the induced camber from one side of the mast 102 to the other.

Figure 9:
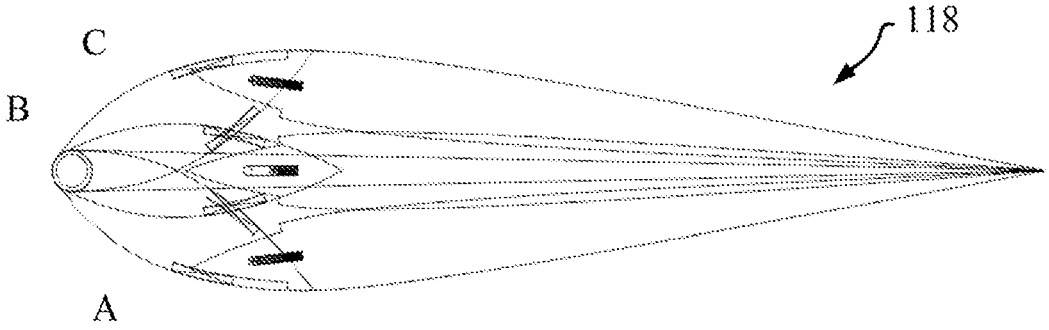
FIG. 9 illustrates an example camber profile formed by a mechanical spring mechanism in three example positions of the wing sail.

Similar to FIG. 4 described above, FIG. 9 illustrates the camber profile formed by the mechanical spring mechanism 118 in three example positions of the wing sail 100, as it moves from a maximum camber position on one side of the mast 102 (position A) through a minimum or neutral camber position (position B) to a second maximum camber position on the other side of the mast 102 (position C). This again allows the wing sail 100 to change the direction of the lift being generated, such as when tacking or otherwise changing directions. As with the pneumatic spring mechanism 116 described above, the reversal may be achieved by applying a compressive force to the mechanical spring mechanism 118 in the cambered region of the wing sail 100, either automatically by wind pressure incident on the sail cover 104 or by some other external force, such as manual force from a user. In this way, the mechanical spring mechanism 118 may be similarly configured to automatically reverse the asymmetric camber between the surfaces 110, 112 of the wing sail 100 in response to wind pressure, making the wing sail 100 self-orienting with regard to the angle of attack and the apparent wind.

Figure 10:
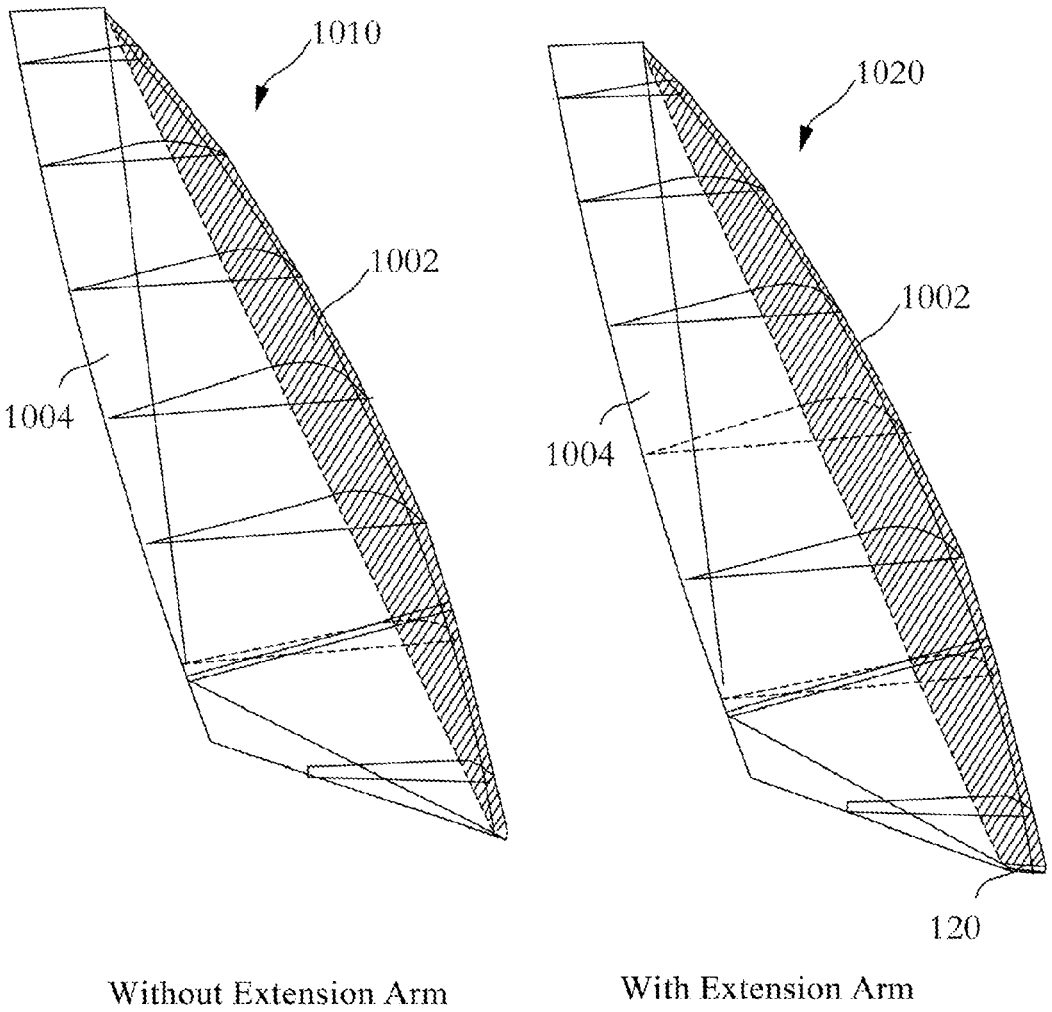
FIG. 10 illustrates the use of an extension arm for extending a leading surface region relative to a trailing surface region of the wing sail.

To control and hold the desired amount of camber, the mechanical spring mechanism 118 may further comprise at least one stop configured to limit the induced camber to a predefined maximum amount. Two example stops 514 are shown in FIGS. 5-9. In this way and by using components of appropriate shapes and dimensions, it is possible to construct the mechanical spring mechanism 118 so as to provide substantially any desired airfoil design. Further, where a thicker airfoil is desired, such as in windsurfing sails, the wing sail 100 may further comprise an extension arm coupled to a base end of the mast 102. An example extension arm 120 is shown in FIG. 1. FIG. 10 illustrates how the extension arm 120 may be used to extend a leading surface region 1002 relative to a trailing surface region 1004, showing a first wing sail design 1010 without an extension arm and a second wing sail design 1020 with the extension arm 120.

Figure 11:
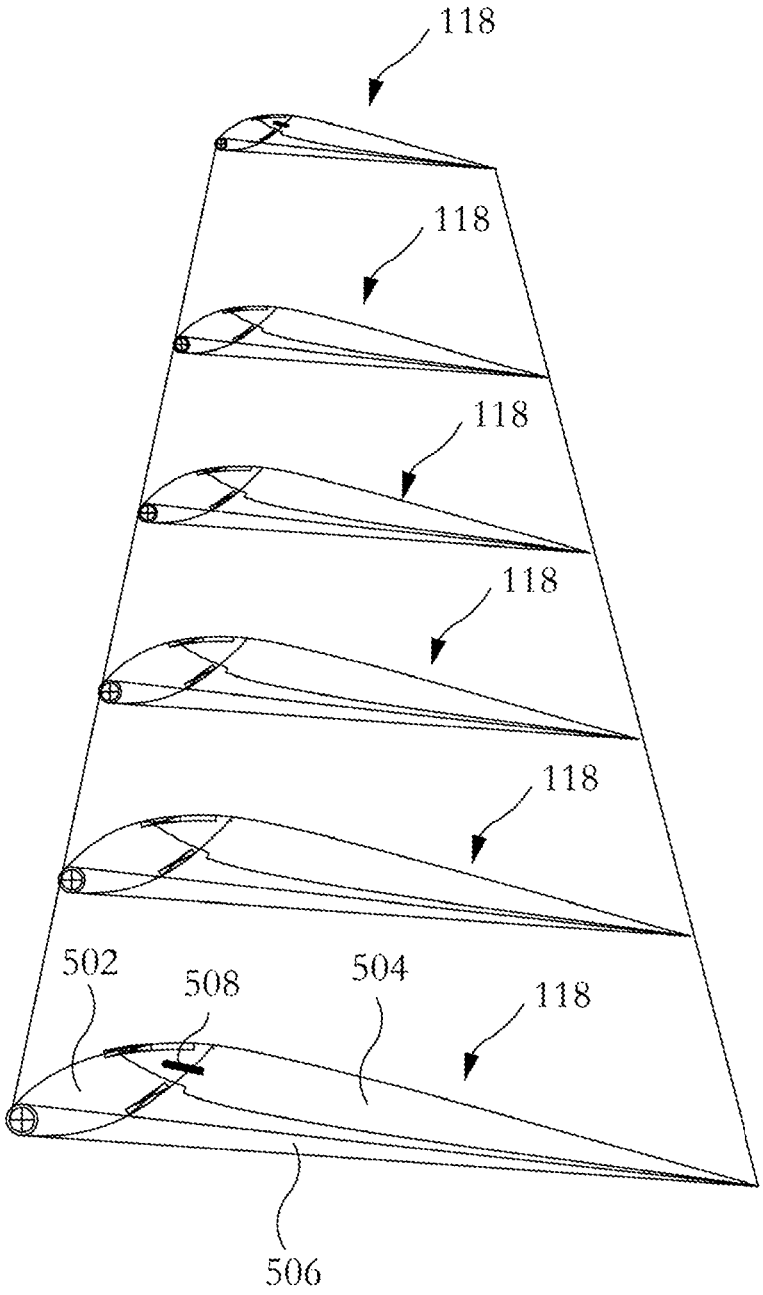
FIG. 11 illustrates a particular embodiment in which a mechanical spring mechanism is employed as the primary camber inducer.
Figure 12:
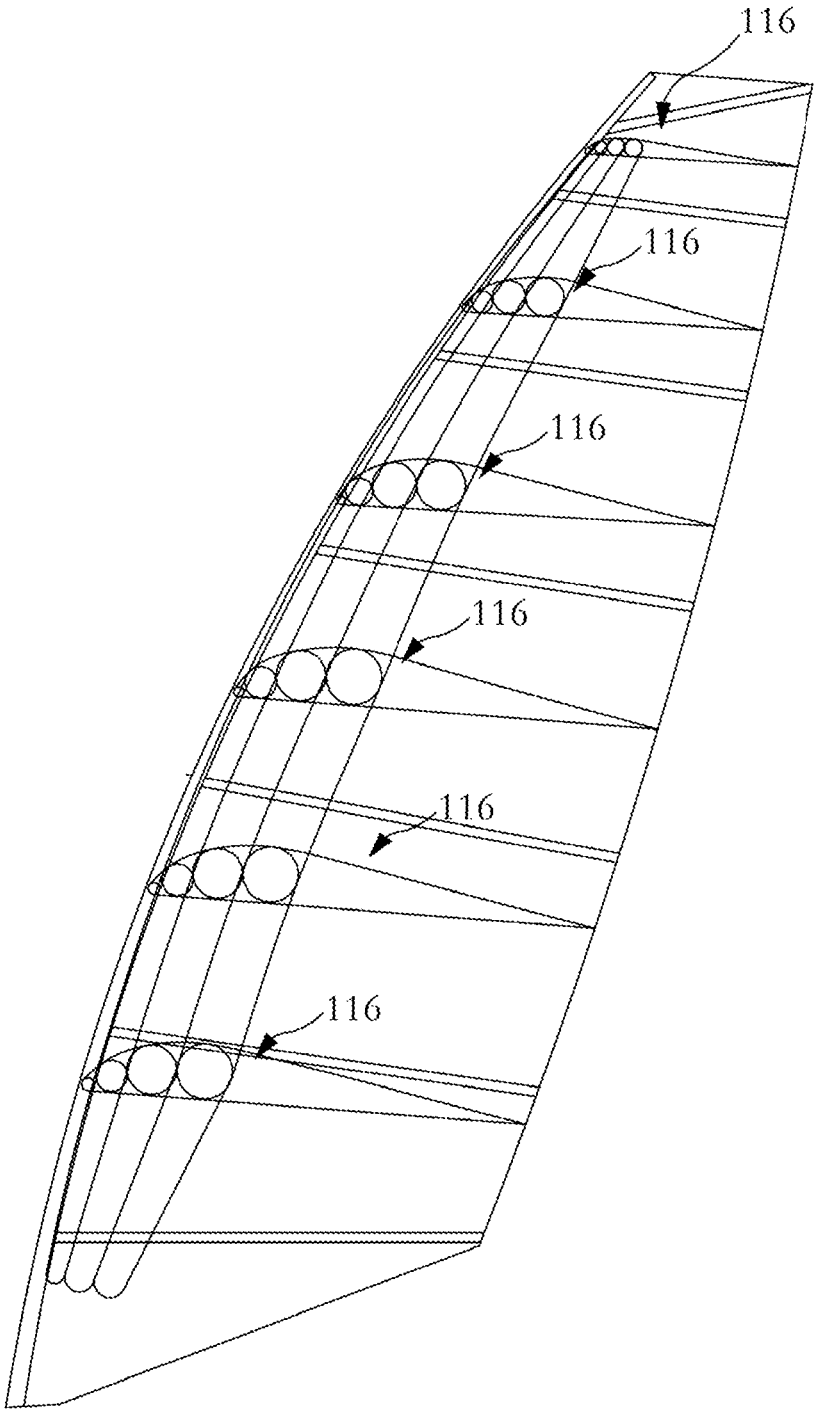
FIG. 12 illustrates a particular embodiment in which a pneumatic spring mechanism is employed as the primary camber inducer.

Returning to FIG. 1, although depicted in combination for illustration purposes, it will be appreciated that the different mechanisms described above for inducing asymmetric camber in the wing sail 100 may be used individually, in addition to in combination, for any given application. For example, in situations where weight is less important than performance (e.g., catamarans or sailboats with a large counterweight), it may be more desirable to use only a mechanical spring mechanism such as the mechanical spring mechanism 118. FIG. 11 illustrates a particular embodiment in which a mechanical spring mechanism 118 is employed as the primary camber inducer. As is further shown here, several such mechanical spring mechanisms 118 may be deployed in tandem, and may be cross-linked through the mast 102 such that less than all of the mechanisms need a respective spring or other elastic member 508. In other situations, such as windsurfing where the weight of the sail is very important, it may be more desirable to use only a pneumatic spring mechanism such as the pneumatic spring mechanism 116. FIG. 12 illustrates a particular embodiment in which a pneumatic spring mechanism 116 is employed as the primary camber inducer. As shown, two or more pneumatic spring mechanisms 116 may similarly be used in tandem. Use of both mechanisms together may be desirable in still other situations, such as where the top of the sail must be light, as in sailfish or dingy boats.

Figure 13:
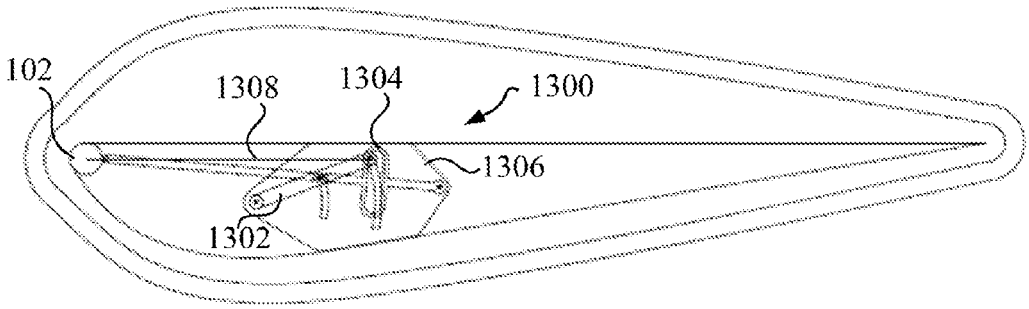
FIG. 13 is a cross-sectional view illustrating yet another mechanical camber inducing mechanism.
Figure 14:
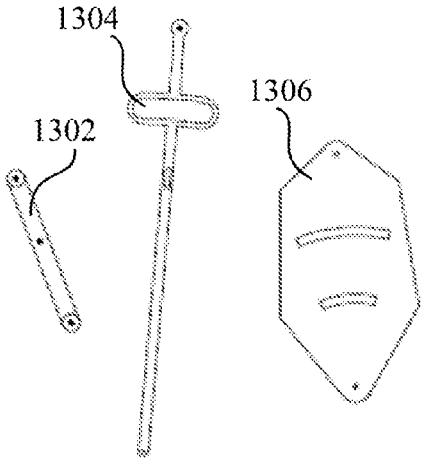
FIG. 14 illustrates components of the mechanism in FIG. 13 in more detail.
Figure 15:
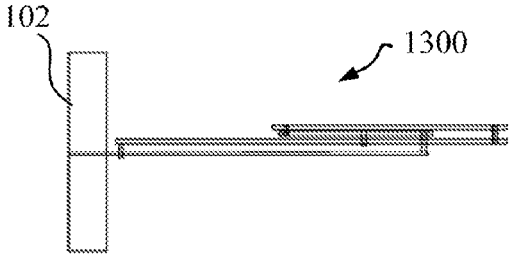
FIG. 15 illustrates a side view of the mechanism shown in FIG. 13.
Figure 16:
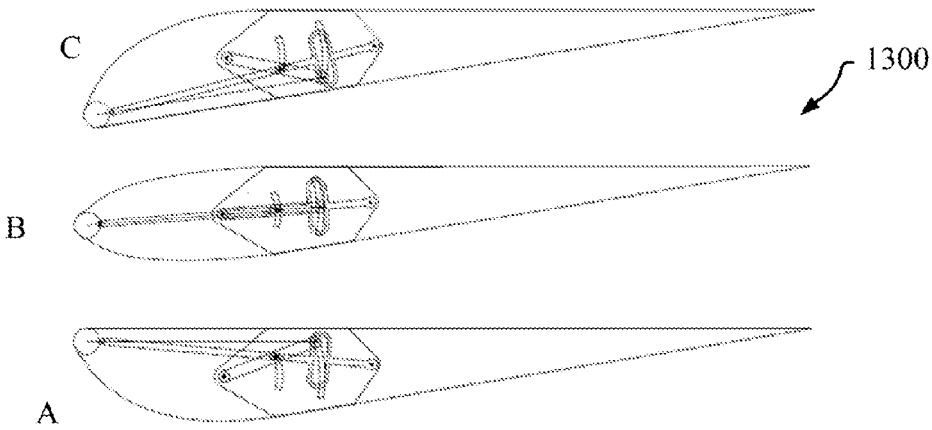
FIG. 16 illustrates the camber profile formed by the mechanism in FIG. 13 in three example positions of the wing sail.

It will also be appreciated that other camber inducer designs may be employed as well, in addition or as an alternative. FIG. 13 is a cross-sectional view illustrating yet another mechanical camber inducing mechanism. FIG. 14 illustrates components of the mechanism in FIG. 13 in more detail. As shown, the mechanism 1300 may be constructed, for example, from a lever 1302, a guide arm 1304, and a main plate 1306 rotatably and/or slidably coupled together by a tensioning member 1308 in the manner shown. The tensioning member 1308 may be or otherwise include a spring or elastic member, or a more rigid member (e.g., rope) providing tension to maintain the desired airfoil shape set by the other components. FIG. 15 illustrates a side view of the mechanism 1300 shown in FIG. 13. FIG. 16 illustrates the camber profile formed by the mechanism 1300 in three example positions of the wing sail, as it moves from a maximum camber position on one side of the mast 102 (position A) through a minimum or neutral camber position (position B) to a second maximum camber position on the other side of the mast 102 (position C).

The wing sails thus described according to various embodiments are able to adjust the camber of their airfoil shape and reverse the camber from one side of the sail to the other, making them useful when tacking and so on. Their aerodynamically efficient sail shape provides improved performance, closer to the theoretical limits of subsonic aerodynamics at all altitudes and conditions of operation, without requiring complicated external control forces and at the same time being relatively easy to manufacture, repair, and maintain, thereby further providing improved cost efficiencies.

The preceding description is provided to enable any person skilled in the art to make or use embodiments of the present invention. It will be appreciated, however, that the present invention is not limited to the particular formulations, process steps, and materials disclosed herein, as various modifications to these embodiments within the scope of the claims will be readily apparent to those skilled in the art. That is, the generic principles defined herein may be applied to other embodiments without departing from the spirit or scope of the invention, which should only be defined by the following claims and all equivalents.

The invention claimed is:

1. A reversible wing sail for use with a wind-powered vehicle, the wing sail comprising:

a rotatable mast having a longitudinally extending mast axis;

a multi-surface sail cover running along at least a portion of the mast and extending transversely in relation to the mast from a leading edge to a trailing edge, the sail cover having a first surface and a second surface that form a cavity therebetween, each surface having an inner side exposed to the inside of the cavity and an outer side exposed to the outside air; and a spring-assisted camber inducer arranged in the cavity between the first and second surfaces of the sail cover and configured to induce an asymmetric camber profile between the first and second surfaces to form the wing sail into an airfoil shape, wherein the spring-assisted camber inducer comprises a pneumatic spring mechanism and a mechanical spring mechanism arranged in combination, the pneumatic spring mechanism being formed from an array of air-filled cells that comprises at least two air-filled cells connected in sequence to one another, including a front cell disposed closest to the mast and a back cell disposed furthest away from the mast, the back cell being fixedly attached to the inner sides of the first and second surfaces of the sail cover, wherein the pneumatic spring mechanism is arranged to induce the wing sail into the asymmetric profile, and the mechanical spring mechanism being formed from two or more rigid members rotatably coupled together by an elastic member, wherein the rigid members comprise a camber plate rotatably coupled to the mast and extending from the mast toward the trailing edge of the sail cover, a trailing surface arm rotatably and slidably coupled to the camber plate and extending from the camber plate toward the trailing edge of the sail cover, and an inner surface arm rotatably coupled to the mast and the trailing surface arm, and wherein the elastic member is a spring configured to drive the camber plate and the trailing surface arm into an extended position relative to the inner surface arm.

2. The wing sail of claim 1, wherein the spring-assisted camber inducer is further configured to reverse the orientation of the asymmetry in the camber profile between the first and second surfaces in response to wind pressure incident on the sail cover.

3. The wing sail of claim 1, wherein the spring-assisted camber inducer forms an asymmetric camber leading surface region in the sail cover that extends from the leading edge to a mid-point short of the trailing edge and a symmetric camber trailing surface region in the sail cover that extends from the mid-point to the trailing edge.

4. The wing sail of claim 3, further comprising an extension arm coupled to a base end of the mast and configured to extend the leading surface region of the sail cover relative to the trailing surface region.

5. The wing sail of claim 1, wherein each air-filled cell extends in the longitudinal direction at least halfway along the mast.

6. The wing sail of claim 1, further comprising one or more camber holders configured to rotatably couple the front cell to the mast.

7. The wing sail of claim 1, wherein the mechanical spring mechanism further comprises at least one stop configured to limit the induced camber to a predefined maximum amount.

8. The wing sail of claim 1, wherein the spring-assisted camber inducer further comprises a second mechanical spring mechanism formed from a lever, a guide arm, and a main plate rotatably and/or slidably coupled together by a tensioning member.

9. A reversible wing sail for use with a wind-powered vehicle, the wing sail comprising:

a rotatable mast having a longitudinally extending mast axis;

a multi-surface sail cover running along at least a portion of the mast and extending transversely in relation to the mast from a leading edge to a trailing edge, the sail cover having a first surface and a second surface that form a cavity therebetween, each surface having an inner side exposed to the inside of the cavity and an outer side exposed to the outside air; and a spring-assisted camber inducer arranged in the cavity between the first and second surfaces of the sail cover and configured to induce an asymmetric camber profile between the first and second surfaces to form the wing sail into an airfoil shape, wherein the spring-assisted camber inducer comprises a pneumatic spring mechanism formed from an array of air-filled cells that comprises at least two air-filled cells connected in sequence to one another, including a front cell disposed closest to the mast and a back cell disposed furthest away from the mast, the back cell being fixedly attached to the inner sides of the first and second surfaces of the sail cover, wherein the pneumatic spring mechanism is arranged to induce the wing sail into the asymmetric profile.

10. The wing sail of claim 9, wherein the spring-assisted camber inducer is further configured to reverse the orientation of the asymmetry in the camber profile between the first and second surfaces in response to wind pressure incident on the sail cover.

11. The wing sail of claim 9, wherein the spring-assisted camber inducer forms an asymmetric camber leading surface region in the sail cover that extends from the leading edge to a mid-point short of the trailing edge and a symmetric camber trailing surface region in the sail cover that extends from the mid-point to the trailing edge.

12. The wing sail of claim 11, further comprising an extension arm coupled to a base end of the mast and configured to extend the leading surface region of the sail cover relative to the trailing surface region.

13. The wing sail of claim 9, wherein each air-filled cell extends in the longitudinal direction at least halfway along the mast.

14. The wing sail of claim 9, further comprising one or more camber holders configured to rotatably couple the front cell to the mast.

15. A reversible wing sail for use with a wind-powered vehicle, the wing sail comprising:

a rotatable mast having a longitudinally extending mast axis;

a multi-surface sail cover running along at least a portion of the mast and extending transversely in relation to the mast from a leading edge to a trailing edge, the sail cover having a first surface and a second surface that form a cavity therebetween; and a spring-assisted camber inducer arranged in the cavity between the first and second surfaces of the sail cover and configured to induce an asymmetric camber profile between the first and second surfaces to form the wing sail into an airfoil shape, wherein the spring-assisted camber inducer comprises a mechanical spring mechanism formed from two or more rigid members rotatably coupled together by an elastic member, wherein the rigid members comprise a camber plate rotatably coupled to the mast and extending from the mast toward the trailing edge of the sail cover, a trailing surface arm rotatably and slidably coupled to the camber plate and extending from the camber plate toward the trailing edge of the sail cover, and an inner surface arm rotatably coupled to the mast and the trailing surface arm, wherein the elastic member is attached to the camber plate substantially on a longitudinal centerline and proximate the trailing end of the camber plate, and wherein the elastic member is a spring configured to drive the camber plate and the trailing surface arm into an extended position relative to the inner surface arm.

16. The wing sail of claim 15, wherein the spring-assisted camber inducer is further configured to reverse the orientation of the asymmetry in the camber profile between the first and second surfaces in response to wind pressure incident on the sail cover.

17. The wing sail of claim 15, wherein the spring-assisted camber inducer forms an asymmetric camber leading surface region in the sail cover that extends from the leading edge to a mid-point short of the trailing edge and a symmetric camber trailing surface region in the sail cover that extends from the mid-point to the trailing edge.

18. The wing sail of claim 15, further comprising an extension arm coupled to a base end of the mast and configured to extend the leading surface region of the sail cover relative to the trailing surface region.

* * * * *